United States Patent [19]

Segars et al.

[11] Patent Number: 5,056,733

[45] Date of Patent: Oct. 15, 1991

[54] TUBULAR YARN CARRIER HAVING IMPROVED NOSE CONSTRUCTION

[75] Inventors: Jack W. Segars; Roland S. Watford, Jr., both of Hartsville, S.C.

[73] Assignee: Sonoco Products Company, Hartsville, S.C.

[21] Appl. No.: 517,215

[22] Filed: May 1, 1990

[51] Int. Cl.[5] ..... B65H 75/10

[52] U.S. Cl. ..... 242/118.32

[58] Field of Search ..... 242/118.32, 118.3, 118.31

[56] References Cited

U.S. PATENT DOCUMENTS

| | | | |
|---|---|---|---|
| 1,839,184 | 12/1931 | Kircher | 242/118.32 X |
| 1,858,410 | 5/1932 | Morey | 242/118.32 X |
| 2,006,797 | 7/1935 | Dunlap | 242/118.32 |
| 2,219,836 | 10/1940 | Dunlap | 242/118.32 |
| 2,288,966 | 7/1942 | Blanchet | 242/118.32 |
| 2,765,129 | 10/1956 | Dunlap | 242/118.32 |
| 3,224,696 | 12/1965 | Hendry, Jr. | 242/118.32 X |
| 3,990,649 | 11/1976 | Adams | 242/118.32 |
| 4,700,834 | 10/1987 | Martinez | 242/118.32 X |
| 4,700,904 | 10/1987 | Martinez | 242/118.32 X |

FOREIGN PATENT DOCUMENTS

| | | |
|---|---|---|
| 140342 | 2/1951 | Australia . |
| 140938 | 4/1951 | Australia . |
| 327998 | 7/1935 | Italy . |
| 323573 | 9/1957 | Switzerland . |
| 932410 | 7/1963 | United Kingdom . |

*Primary Examiner*—Stanley N. Gilreath

*Attorney, Agent, or Firm*—Bell, Seltzer, Park & Gibson

[57] ABSTRACT

A method and apparatus are disclosed for forming a tubular yarn carrier of the type adapted to have a yarn wound thereon to form a yarn package, and which includes an inturned annular end portion which is adapted to support the carrier on an internal spindle of a winding machine. The method of forming the inturned annular end portion includes inwardly turning one end of a tubular body member and so as to cause the end to be inwardly turned about an arc of about 180°, and while concurrently guiding the inwardly turned end radially outwardly into contact with the inside wall surface of the tubular member. The method results in the formation of a frusto-conical end portion which essentially locks against the inside wall surface of the carrier and thus prevents the inturned end portion from opening up during use.

4 Claims, 2 Drawing Sheets

TUBULAR YARN CARRIER HAVING IMPROVED NOSE CONSTRUCTION

BACKGROUND OF THE INVENTION

The present invention relates to a tubular yarn carrier which is adapted to have a yarn wound thereon to form a yarn package, and which includes an inturned end portion forming a nose which is adapted to support the carrier on an internal spindle of a winding machine.

Yarn carriers of the described type are conventionally formed from paper sheets which are convolutely wound into tubular form, which commonly has a somewhat conical configuration. Such carriers also commonly include an inturned nose at one end thereof, which serves to support the carrier on an internal spindle of a winding machine. Carriers of this general type are disclosed, for example, in the U.S. Pat. Nos. to Blanchet, 2,288,966; Dunlap, 2,765,129; and Hendry, 3,224,696.

A persistent problem associated with carriers of the described type is the fact that the inturned nose will open up in use, particularly when operated under conditions of high humidity, and the carrier thus becomes unusable. Recently, in an effort to alleviate this problem, it has been proposed to fabricate the inturned nose so as to include a pressed in ridge at the termination of the nose which in effect forms a frusto-conical surface around the inside of the nose and which tends to more permanently lock the nose into contact with the periphery of the inside wall of the carrier.

The above nose construction has proven to be more effective in preventing the opening of the nose during use. However, further improvement of the permanency of the locked-in nose is desirable, and in addition, there heretofore has been no satisfactory method and apparatus for forming a carrier having the described nose construction.

It is accordingly an object of the present invention to provide a yarn carrier which is fabricated of convolutely wound layers of paper, and which has a nose construction which provides improved resistance to the opening up of the nose during use of the carrier, particularly under high humidity conditions.

It is a further object of the present invention to provide a method and apparatus for efficiently forming a tubular yarn carrier having an inturned nose at one end, and wherein the nose is characterized as being locked into contact with the inside wall of the carrier.

SUMMARY OF THE INVENTION

The above and other objects and advantages are achieved by the novel method and apparatus of the present invention, and which includes the steps of forming a tubular body member by convolutely winding at least one paper sheet, supporting the body member so as to define a central axis, inwardly turning one end of the body member and so as to cause such one end of the body member to be inwardly turned about an arc of about 180° and then to be moved in an axial direction within said body member, and while guiding the inwardly turned and axially moving one end of the tubular member radially outwardly into contact with the inside wall surface of the tubular member and so as to form a frusto-conical end portion which is disposed at an angle of between about 35°–45° with respect to said central axis.

In the preferred embodiment, the step of inwardly turning one end of the body member includes pressing such one end against a die which includes a transversely curved annular groove of generally semicircular cross section and which is concentric to the central axis and of a diameter so as to receive the one end in the maximum diameter portion of the annular groove. Also, it is preferred that the body member and the die relatively rotate about the central axis during the pressing step.

Further, in the preferred embodiment, the step of guiding the inwardly turned and axially moving one end of the tubular body member includes positioning a supporting tool coaxially into the tubular body member from the end thereof opposite the one end. The supporting tool has an annular, frusto-conical forward end surface which is positioned in axial alignment with and opposing the annular groove, and so that the inwardly turned end axially moving one end of the body member contacts the forward end surface and is guided thereby radially outwardly.

The resulting yarn carrier comprises a tubular body portion composed of convolutely wound layers of paper, and an inturned annular end portion which is integrally connected to one of the ends of the body portion. The inturned annular end portion includes a U-shaped portion which has one end thereof joined to such one end of the body portion, and an opposite inner end positioned within the body portion. Also, a frusto-conical portion extends radially outwardly from the opposite inner end of the U-shaped portion, and into contact with the inside wall surface of the body portion, and with the frusto-conical portion being disposed at a angle of between about 35°–45° with respect to the central axis. Further, the yarn carrier preferably also includes a frusto-conical outer surface portion positioned at the juncture of the joined ends of the tubular body portion and the U-shaped portion, and which is inclined at an angle of between about 8° to 12° from the central axis. This frusto-conical outer surface portion has been found to further improve the locked-in characteristic of the inturned end portion or nose.

BRIEF DESCRIPTION OF THE DRAWINGS

Some of the objects and advantages of the present invention having been stated, others will appear as the description proceeds, when taken in conjunction with the accompanying drawings in which.

DETAILED DESCRIPTION OF THE PREFERRED EMBODIMENTS

Figure 1:
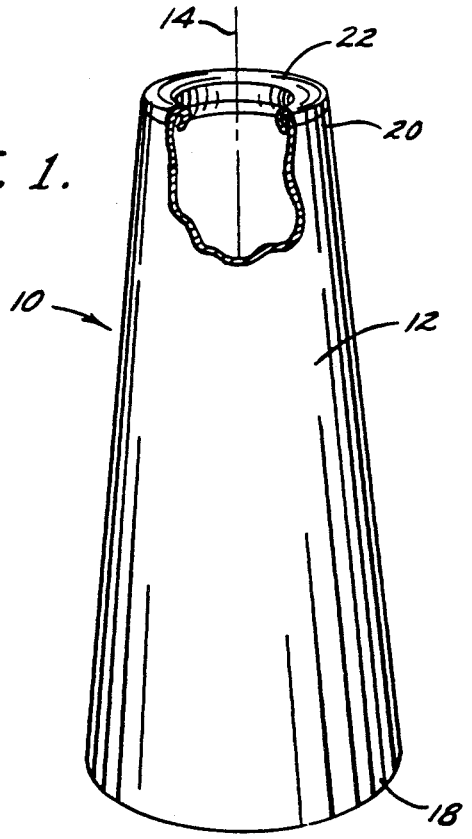
FIG. 1 is a perspective view of a conical yarn carrier, with a portion broken away, and which embodies the present invention.
Figure 5:
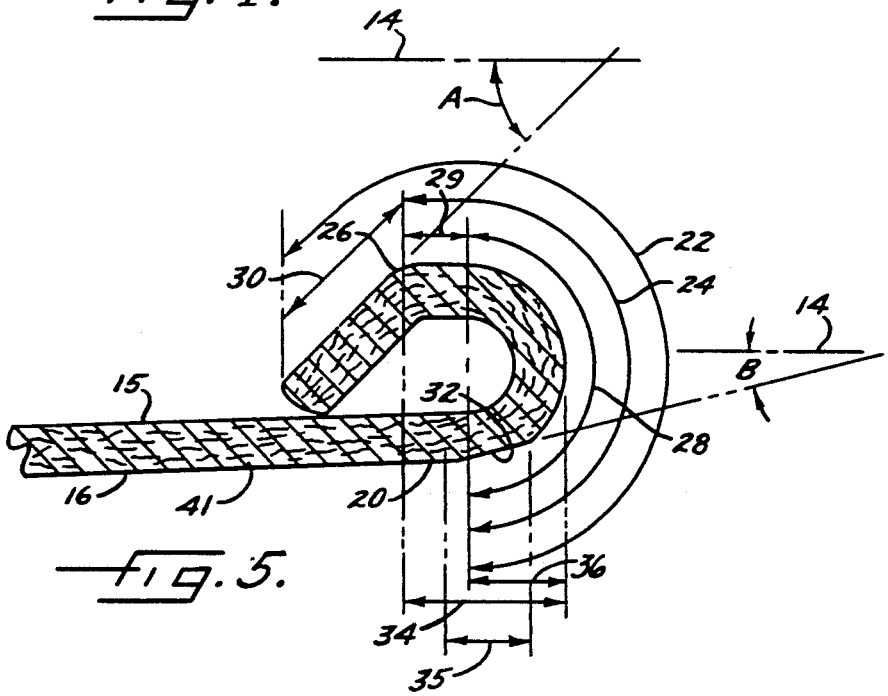
FIG. 5 is an enlarged sectioned fragmentary view of the nose portion of the carrier of the present invention.

Referring initially to FIGS. 1 and 5, a yarn carrier which embodies the features of the present invention is indicated generally at 10. The carrier 10 comprises a tubular body portion 12 which is composed of a wall of frusto-conical configuration in the illustrated embodiment. Also, the body portion 12 is composed of a number of wound layers of paper in accordance with conventional practice. The body portion 12 defines a central axis 14, parallel inside and outside wall surfaces 15, 16, a base end 18, and an opposite smaller end 20. As is conventional, the wall is disposed at an angle of about 2° from the central axis, which provides the indicated frusto-conical configuration.

An inturned annular end or nose 22 is integrally connected to the smaller end 20 of the body portion. The nose includes a U-shaped portion 24 which has one end thereof joined to the smaller end 20 of the body portion, and an opposite inner end 26 which is positioned within the body portion. Further, the U-shaped portion 24 is composed of an arcuate portion 28 which is curved over an arc of about 180°, and an inner generally cylindrical portion 29 which also defines the opposite inner end 26 of the U-shaped portion 24. In addition, the nose 22 includes a frusto-conical portion 30 which extends radially outwardly from the opposite inner end 26 of the U-shaped portion and into contact with the inside wall surface 15 of the body portion. Preferably, the frusto-conical portion 30 is disposed at an angle of A of between about 35°–45° with respect to the central axis 14.

The yarn carrier 10 further includes a frusto-conical outer surface portion 32 which has an axial length 35 (FIG. 5) and which extends from a point adjacent the juncture of the smaller end 20 of the body portion and the adjacent end of the U-shaped portion 24, and along a substantial portion of the axial length 36 of the arcuate portion 28. This frusto-conical surface portion 32 is preferably inclined at an angle B of between about 8° to 12° from the central axis 14.

As best seen in FIG. 5, the U-shaped portion 24 of the nose 22 extends along a predetermined axial length 34, and the axial length 35 of the frusto-conical outer surface portion 32 is equal to at least about one half the predetermined axial length of the U-shaped portion 24.

Figure 2:
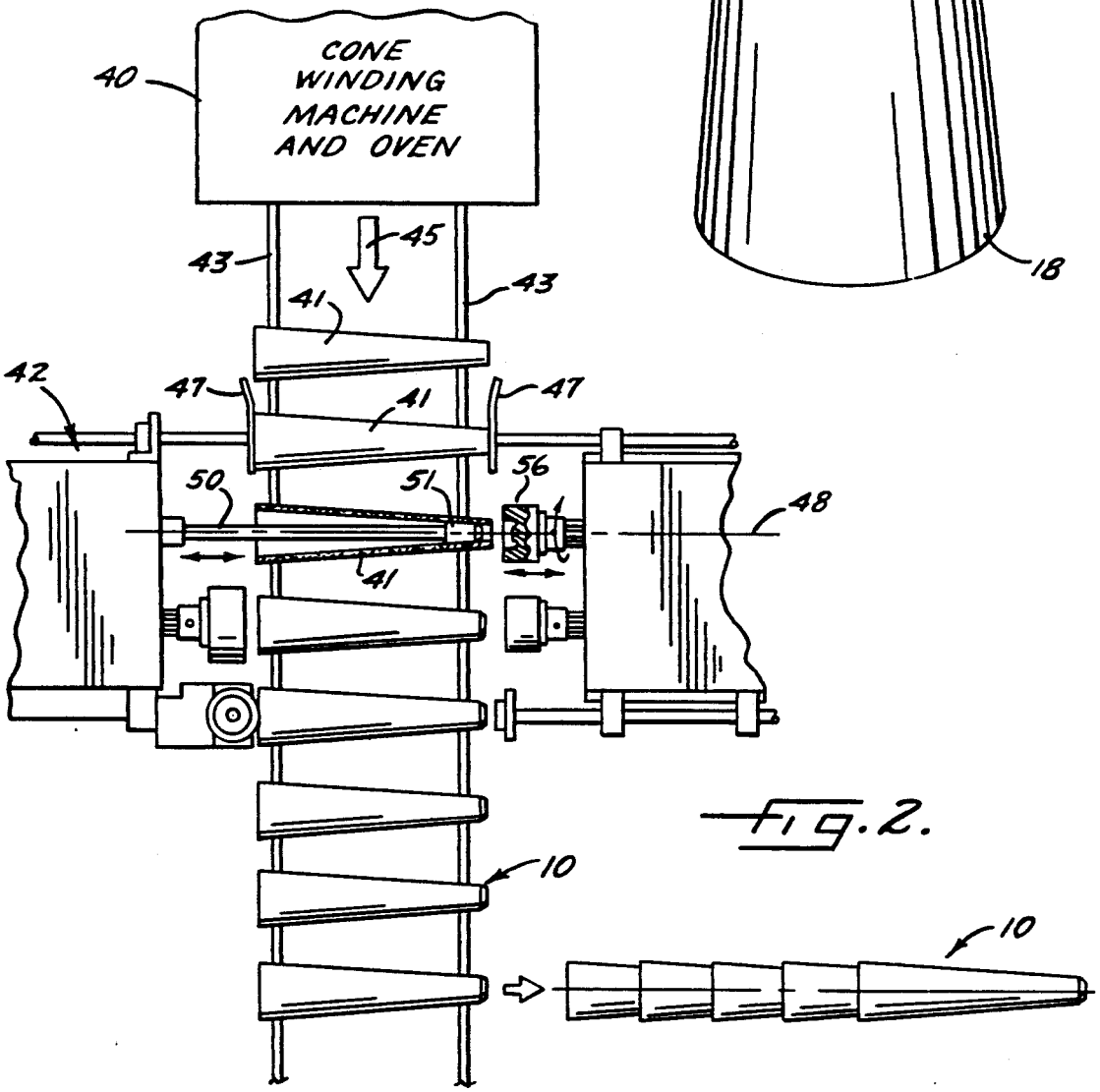
FIG. 2 is a somewhat schematic view of an apparatus for forming the carrier of the present invention.
Figure 3:
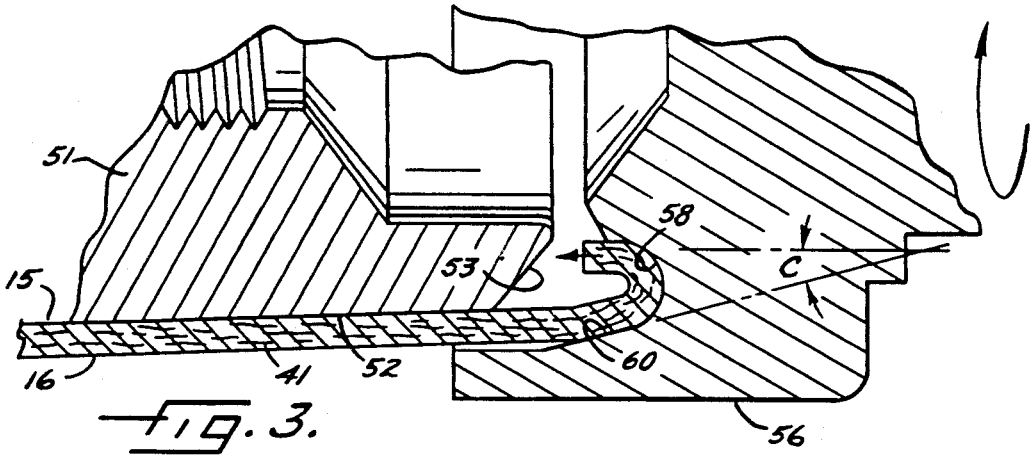
FIG. 3 is an enlarged sectional and fragmentary view of the nose forming station and taken during the initial stage of the nose forming operation.
Figure 4:
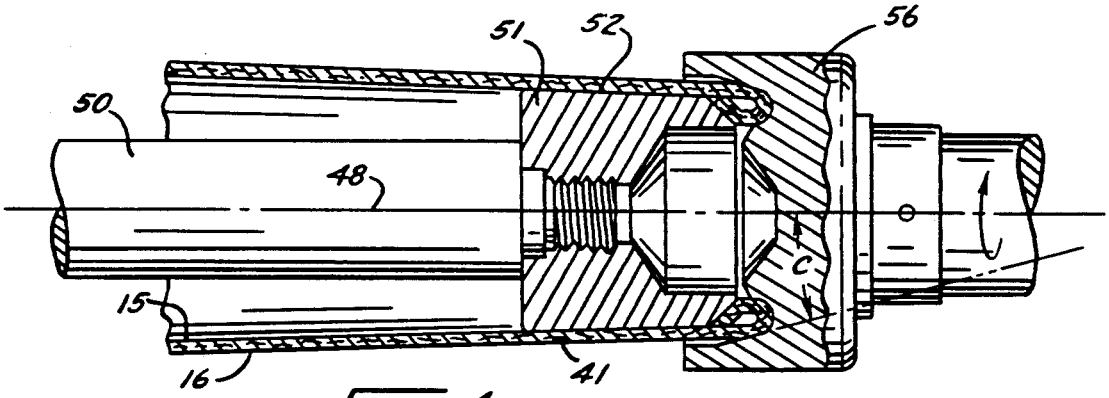
FIG. 4 is a view similar to FIG. 3 but illustrating a later stage of the nose forming operation.

The above described yarn carrier 10 may be efficiently manufactured by the method and apparatus as schematically illustrated in FIGS. 2–4. In the illustrated embodiment, the apparatus includes a conventional cone winding machine 40, wherein sheets of fibrous paper are serially wound on a tapered mandrel to form conical tubular body members 41, and then dried in an oven. Also, during the winding operation, a pair of rotary knife blades (not shown) cut the resulting tubular body members to proper length.

From the cone winding machine 40, the wound tubular body members 41 are then conveyed incrementally between work stations of a finishing machine 42 and which are positioned along a path of travel defined by a pair of parallel conveyers 43, and in the direction indicated by the arrow 45. At the initial station of the finishing machine, the tubular body members 41 are axially positioned on the conveyers 43 by the guide plates 47, and a lubricant may be applied to the small or nose end of each tubular member in a conventional manner. At a second station, each tubular body member 41 is supported by the conveyors 43 so as to define a central axis 48, and a non-rotating supporting tool 50 is inserted coaxially into the large end of the tubular member 41. The supporting tool 50 includes a head 51 having a frusto-conical peripheral surface 52 which is concentric to the central axis 48 and which matches the curvature and diameter of the inside wall surface 15 of the body member adjacent the small end thereof. The supporting tool 50 is thus able to engage the body member and support the same in a fixed axial position. The supporting tool 50 also includes an annular, frusto-conical, forward end surface 53 which is concentric to the central axis 48.

A die 56 is also positioned at the second work station, and the die 56 is mounted for rotation about the central axis 48, and also for axial movement toward and away from the head 51 of the supporting tool along the central axis. As best seen in FIG. 3, the die 56 includes a transversely curved annular groove 58 of generally semi-circular cross section and which is sized so as to be adapted to receive the adjacent end of the tubular body member in the maximum diameter portion of the annular groove.

The apparatus also includes control means (not shown) for controlling the axial movements of the die 56 and the supporting tool 50 such that the supporting tool is initially advanced to its operative position inside the tubular member 41 and immediately adjacent the small end of the tubular member and opposing the annular groove 58 of the die 56 as seen in FIG. 2. The die 56 is then rotated and advanced forwardly into contact with the small end of the body member, and the end is thereby caused to enter the large diameter portion of the annular groove and to be inwardly turned about an arc of about 180° and then moved in an axial direction within the tubular body member as indicated in FIG. 3. The inwardly turned and axially moving leading end of the tubular member then engages the frusto-conical forward end surface 53 of the supporting tool 50, which causes the axially moving leading end to be guided radially outwardly along the surface thereof. As a result, and as indicated in FIG. 4, the frusto-conical portion 30 is formed which extends radially outwardly and into contact with the inside wall surface 15 of the body portion, and which matches the curvature of the forward end surface 53. The result is the inturned annular end portion or nose 22 a described above.

The fact that the nose 22 is formed in a continuous process, is thought to be significant in that the leading end of the frusto-conical portion moves radially into contact with the inside wall surface 15 of the body portion, as opposed to being subsequently folded and moved into contact in an essentially axial direction. The resulting structure is seen to provide an essentially locked interconnection between the resulting frusto-conical portion 30 and the inside wall surface 15 of the body member, which effectively resists the opening up of the nose 22.

Again viewing FIGS. 3 and 4, it will be seen that the die 56 further includes a frusto-conical surface portion 60 at the outer periphery of the groove 58 and which is inclined at an angle C of about 10° from the central axis. This frusto-conical surface portion 60 results in the formation of the above described frusto-conical outer surface portion 32 which is positioned at the juncture of the end 20 of the body portion and the adjacent end of the U-shaped portion 24, and which is inclined at an angle of about 10° of the central axis 14. As noted above, this frustoconical outer surface portion has been found to further enhance the locked-in characteristic of the inturned annular end portion or nose.

Upon completion of the formation of the nose 22, the supporting tool 50 and the die 56 are axially withdrawn, and the tubular body member 41 is then conveyed to the next work station, which may for example comprise a grinding wheel and back-up chuck as described in copending and commonly owned application Ser. No. 07/498,987, filed Mar. 26, 1990. From the grinding work station, the tubular body members 41 may be conveyed to another downstream work station wherein conventional scoring or notching operations may be performed, if desired.

In the drawings and specification, there has been set forth a preferred embodiment of the invention, and although specific terms are employed, they are used in a generic and descriptive sense only and not for purposes of limitation.

That which is claimed is:

1. A tubular yarn carrier which is adapted to have a year wound thereon to form a yarn package, and comprising a tubular body portion composed of convolutely wound layers of paper, and with said body portion defining a central axis, an inside wall surface, an outside wall surface, and opposite ends, an inturned annular end portion integrally connected to one of said ends of said body portion and including a U-shaped portion which has one end thereof joined to said one end of said body portion and an opposite inner end positioned within said body portion, said U-shaped portion including an arcuate portion which is curved over an arc of about 180° from said one end of said U-shaped portion and extends along a predetermined axial length, and a frusto-conical portion which extends radially outwardly from said opposite inner end of said U-shaped portion and into contact with aid inside wall surface of said body portion, and with said frusto-conical portion being disposed at an angle of between about 35°–45° with respect to said central axis, and a frusto-conical outer surface portion positioned to extend from a point adjacent said one end of said body portion and along a substantial portion of said predetermined axial length of said arcuate portion, and with said frusto-conical surface portion being inclined at an angle of between about 8° to 12° from said central axis.

2. The yarn carrier as defined in claim 1 wherein said body portion is frusto-conical and so that said inside and outside wall surfaces are each disposed at an angle of about 2° from said central axis, and wherein said one end of said body portion comprises the smaller diameter end thereof.

3. The yarn carrier as defined in claim 1 wherein said U-shaped portion of said inturned annular end portion further includes an inner generally cylindrical portion which defines said opposite inner end of said U-shaped portion.

4. The yarn carrier as defined in claim 3 wherein said U-shaped portion of said inturned annular end portion extends along a predetermined axial length, and said frusto-conical outer surface portion has an axial length equal to at least about one half said predetermined axial length of said U-shaped portion.

* * * * *

UNITED STATES PATENT AND TRADEMARK OFFICE

CERTIFICATE OF CORRECTION

PATENT NO. : 5,056,733

DATED : October 15, 1991

INVENTOR(S) : Jack W. Segars and Roland S. Watford, Jr.

It is certified that error appears in the above-identified patent and that said Letters Patent is hereby corrected as shown below:

IN THE CLAIMS:

Column 5, line 29 "aid" should be -- said --.

Signed and Sealed this

Second Day of March, 1993

*Attest:*

STEPHEN G. KUNIN

*Attesting Officer*

*Acting Commissioner of Patents and Trademarks*